US006312192B1

(12) United States Patent
Déry

(10) Patent No.: US 6,312,192 B1
(45) Date of Patent: Nov. 6, 2001

(54) FLOOD CONTROL BARRIER

(76) Inventor: Daniel Déry, 167 Ave. Du Lac, St-Christophe d'Arthabaska, Quebec (CA), G6P 6S1

( * ) Notice: Subject to any disclaimer, the term of this patent is extended or adjusted under 35 U.S.C. 154(b) by 0 days.

(21) Appl. No.: 09/667,626

(22) Filed: Sep. 22, 2000

Related U.S. Application Data

(63) Continuation of application No. PCT/CA99/00243, filed on Mar. 22, 1999.

(60) Provisional application No. 60/079,119, filed on Mar. 23, 1998.

(30) Foreign Application Priority Data

Nov. 26, 1998 (CA) ..... 2254790

(51) Int. Cl.[7] ..... E02B 3/10; E02B 7/02

(52) U.S. Cl. ..... 405/115; 405/21; 405/32; 405/91; 405/107

(58) Field of Search ..... 405/16, 21, 22, 405/25, 32, 33, 91, 107, 110, 111, 112, 115

(56) References Cited

U.S. PATENT DOCUMENTS

| | | | | |
|---|---|---|---|---|
| 1,077,791 | * | 11/1913 | Blaauw | 405/111 |
| 4,729,691 | * | 3/1988 | Sample | 405/21 |
| 4,981,392 | * | 1/1991 | Taylor | 405/115 |
| 5,059,065 | * | 10/1991 | Doolaege | 405/115 |
| 5,158,395 | * | 10/1992 | Holmberg | 405/21 |
| 5,405,217 | * | 4/1995 | Dias et al. | 405/25 |
| 5,857,806 | * | 1/1999 | Melin | 405/115 |
| 5,865,564 | * | 2/1999 | Miller et al. | 405/115 |

FOREIGN PATENT DOCUMENTS

| | | |
|---|---|---|
| 967 141 | 10/1957 | (DE) . |
| 195 39 611 | 6/1996 | (DE) . |
| 1 002 721 | 6/1997 | (NL) . |

* cited by examiner

*Primary Examiner*—Thomas B. Will
*Assistant Examiner*—Tara L. Mayo
(74) *Attorney, Agent, or Firm*—Swabey Ogilvy Renault

(57) ABSTRACT

A flood control barrier for separating water in a wet area from an area to be maintained substantially dry comprises a flexible exterior membrane made of liquid impervious material and including elongated upper and lower membrane sections joined at a closed longitudinal downstream end of the exterior membrane opposed to an open longitudinal upstream end thereof. The upper and lower membrane sections are connected by internal partition walls and are displaceable between expanded and collapsed positions, wherein in the collapsed position, the upper membrane section overlies the lower membrane section, whereas in the expanded position, the upper membrane section is spaced from the lower membrane section at the open end of the exterior membrane such that water may flow through the open end and be received between the upper and lower membrane sections such as to be trapped therein, i.e. by the closed downstream end thereof which prevents the water from flowing past the barrier. A float may be provided at an upstream end of the upper membrane section such that as water flows towards the barrier, the upper membrane section rises with a level of the flowing water while maintaining the upstream end above the water level. Alternate embodiments include mechanical retention systems and an elongated seal.

31 Claims, 15 Drawing Sheets

B
100
102
104
106
108
110
111
112
114
116
118
120
122
123
124
126
G
L

FLOOD CONTROL BARRIER

CROSS-REFERENCE

This application is a Continuation of PCT/CA99/00243 filed Mar. 22, 1999 designating the United States and claiming priority of U.S. patent application Ser. No. 60/079,119 filed Mar. 23, 1998 and Canadian Patent Application serial No. 2,254,790 filed Nov. 26, 1998.

TECHNICAL FIELD

The present invention relates to flood control equipment and, more particularly, to flood control barriers.

BACKGROUND ART

Unpredictable environmental conditions and development of civilization have led to an increase in terrains subject to flooding. High-yield crop land, residential and commercial structures, roadways, railroads and virtually all forms of civilian developments located adjacent bodies of water such as rivers, lakes and oceans are susceptible to flooding which can potentially cause enormous material damage and also potentially life-threatening situations.

Some areas particularly prone to flooding are typically at least partially protected by permanent earth dikes or levees. However, in certain circumstances, such dikes or levees may prove to be inadequate and subsequently breached, causing flooding and the above mentioned results.

The development of efficient communication methods as well as weather monitoring techniques has led to an increasing number of situations wherein flooding of particular areas may be anticipated with relative accuracy. In such situations, it is typical to attempt to protect flood-prone areas by using sand bag barriers or temporary earthen dikes or levees. In situations wherein permanent earthen levees or dikes are already in place and are being topped by the rising flood waters, wooden planks sand bags or temporary sand or earth fills are typically used to increase the height of such levees. Although somewhat useful, the use of prior art structures such as sand bags for temporarily providing flood protection has proven to be unsatisfactory. Indeed, the erection of sand bags and earth filled barriers are labor and equipment intensive. Furthermore, they are time-consuming especially when considering that the time available to provide at least temporary flood protection in flood-prone areas may range from hours to several days. Also, such prior art structures can rapidly become saturated and structurally weakened to the point of failure. Furthermore, they create a problem with respect to removal after the flood waters have subsided.

SUMMARY OF THE INVENTION

It is therefore an aim of the present invention to provide an improved flood barrier.

It is also an aim of the present invention to provide a novel method for containing a body of water.

Accordingly, there exists a need for an improved flood control barrier and method. Advantages of the present invention include the fact that the flood control barrier is easily transportable and deployable. It may be erected on short notice in the event of rapidly rising flood waters or threatening conditions. Furthermore, it may be easily disassembled and removed from the flood control site. It is also not particularly labor or capital intensive. It is not subject to water saturation and subsequent failure. It may be stored for long terms using relatively small storage space and then used on short notice.

One of the main features of the present invention resides in that it is typically a self-inflated structure that uses the flood-threatening liquid as a medium for inflating its structure. Once properly positioned, the flood-threatening liquid penetrates the barrier as it approaches the protected area without the need for further intervention, the flood threatening liquid acts as an inflatable means.

Therefore, in accordance with the present invention, there is provided a water barrier for separating a wet area from an area to be maintained substantially dry, comprising membrane means having liquid impervious elongated upper and lower wall means joined at a closed longitudinal end of said membrane means opposed to an open longitudinal end thereof, said upper and lower wall means being displaceable between expanded and collapsed positions, said lower wall means being laid on a ground, wherein in said collapsed position, said upper wall means overly said lower wall means, whereas in said expanded position, said upper wall means is spaced from said lower wall means at said open end of said membrane means such that water may flow into said membrane means through said open end while being restricted from flowing downstream past said membrane means by said closed end thereof.

Also in accordance with the present invention, there is provided a barrier for retaining a liquid upstream of said barrier, comprising membrane means having liquid impervious elongated upper and lower wall means joined at a closed longitudinal end of said membrane means opposed to an open longitudinal end thereof, said upper and lower wall means being displaceable between expanded and collapsed positions, said lower wall means being laid on a ground, wherein in said collapsed position, said upper wall means overly said lower wall means, whereas in said expanded position, said upper wall means is spaced from said lower wall means at said open end of said membrane means such that liquid may flow into said membrane means through said open end while being restricted from flowing downstream past said membrane means by said closed end thereof.

Further in accordance with the present invention, there is provided a water barrier for separating a wet area from an area to be maintained substantially dry, comprising liquid impervious elongated upper and lower wall means joined at a closed longitudinal end of said barrier opposed to an open longitudinal end thereof, said upper and lower wall means being displaceable between expanded and collapsed positions, said lower wall means being laid on a ground, wherein from said collapsed position, said upper wall means raises with a level of water up to said expanded position with said upper wall means being spaced from said lower wall means at said open end of said barrier, water in said barrier being restricted from flowing downstream past said barrier by said closed end thereof.

Still further in accordance with the present invention, there is provided a water barrier for separating a wet area from an area to be maintained substantially dry, comprising at least two superposed membrane means each having elongated upper and lower wall means joined at a closed longitudinal end of said membrane means opposed to an open longitudinal end thereof, each said membrane means being adapted to receive water through said open end with said upper wall means being spaced from said lower wall means at said open end of said membrane means in an expanded position of said membrane means such that water in said membrane means and upstream thereof is restricted from flowing downstream past said membrane means by said closed end thereof.

Still further in accordance with the present invention, there is provided a water barrier for separating a wet area from an area to be maintained substantially dry, comprising membrane means having elongated upper and lower wall means joined at a closed longitudinal end of said membrane means opposed to an open longitudinal end thereof, said membrane means being adapted to receive water through said open end with said upper wall means being spaced from said lower wall means at said open end of said membrane means in an expanded position of said membrane means such that water in said membrane means and upstream thereof is restricted from flowing downstream past said membrane means by said closed end thereof.

BRIEF DESCRIPTION OF THE DRAWINGS

Having thus generally described the nature of the invention, reference will now be made to the accompanying drawings, showing by way of illustration a preferred embodiment thereof, and in which.

MODES FOR CARRYING OUT THE INVENTION

Figure 1:
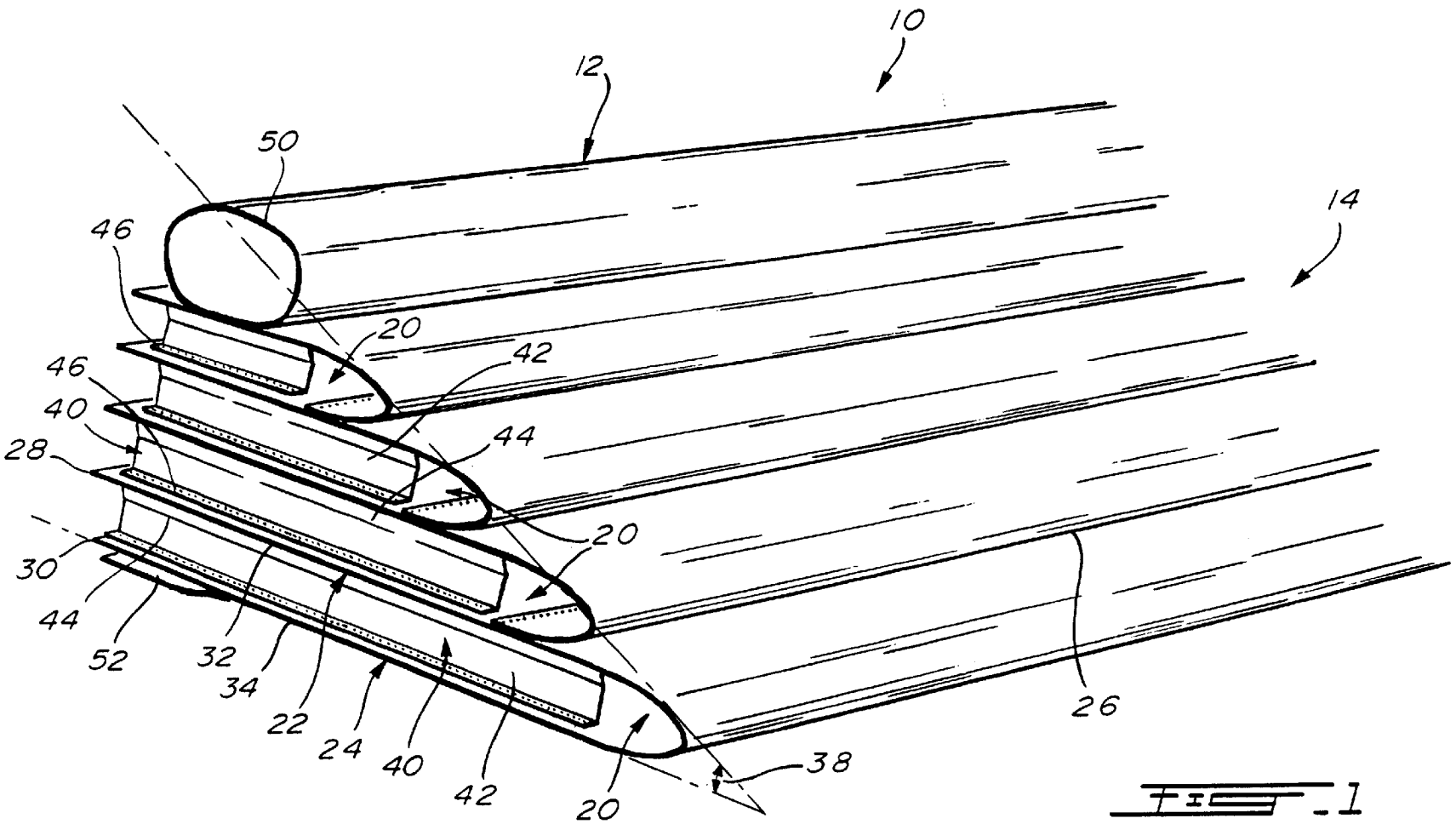
FIG. 1 is a partial front perspective view, with sections taken out, illustrating parts of a flood control barrier in accordance with an embodiment of the present invention.
Figure 2:
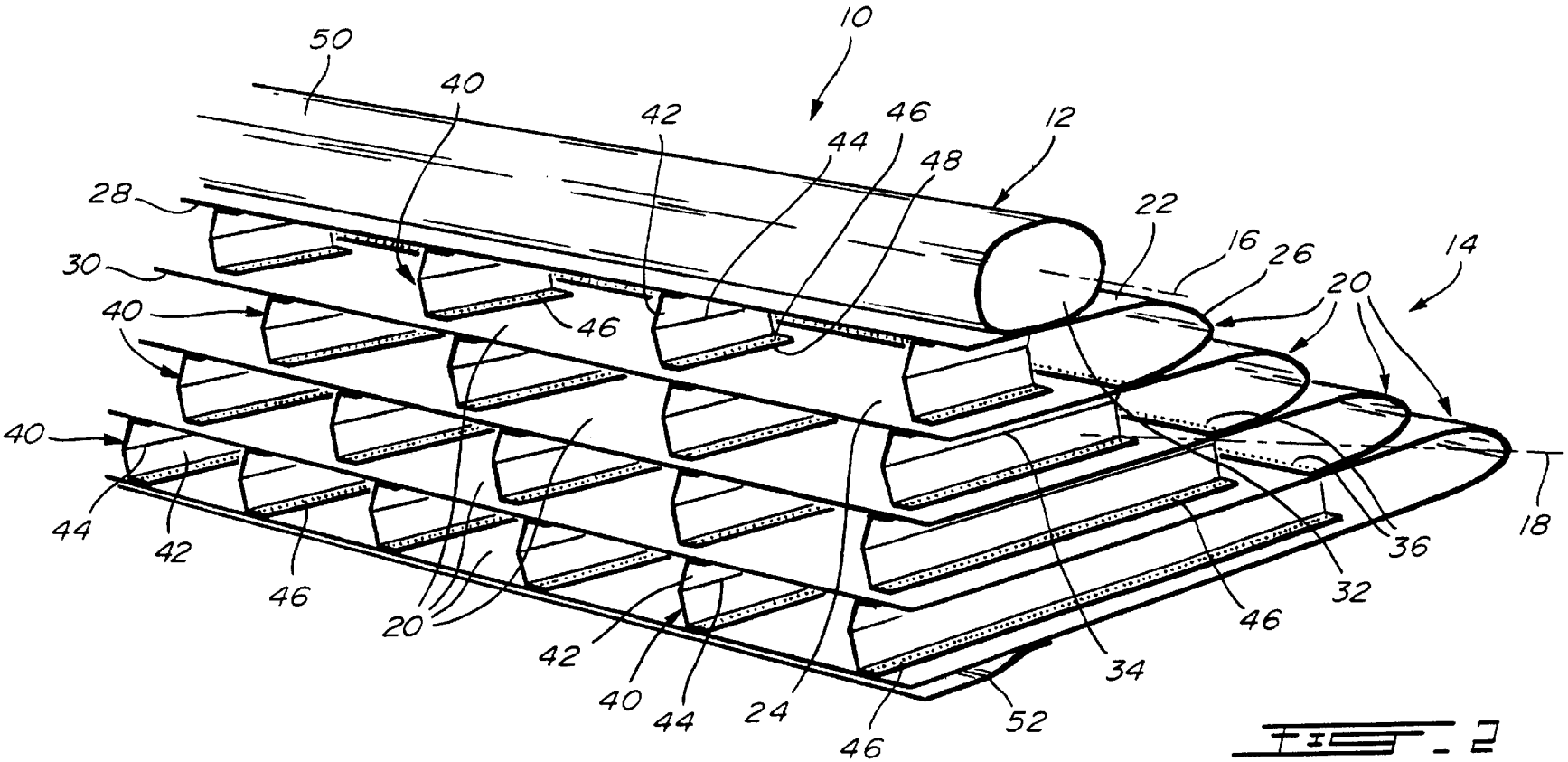
FIG. 2 is a partial rear perspective view illustrating the flood control barrier of FIG. 1.

Referring to FIGS. 1 and 2, there is shown, respectively in front and rear perspective views, part of a flood barrier 10 in accordance with an embodiment of the present invention. The flood barrier 10 includes a floating or buoyant component 12 mounted on top of a flow restricting component 14. Both the buoyant component 12 and flow restricting component 14 preferably have generally elongated configuration defining corresponding buoyant component and flow restricting component longitudinal axis 16 and 18.

The flow restricting component 14 includes at least one and preferably four collapsible compartments 20. It should be understood that although FIGS. 1–7 illustrate a flood barrier using four collapsible compartments 20, the number of collapsible compartments 20 may vary depending on the specific need without departing from the scope of the present invention.

Each collapsible compartment 20 has a generally concave configuration preferably defining a compartment top wall 22, a compartment bottom wall 24 and a compartment distal wall 26. Each compartment top wall 22 and compartment bottom wall 24 defines a corresponding top and bottom wall proximal peripheral edges 28 and 30. Each compartment top and bottom walls 22 and 24 also defines corresponding longitudinally opposed top and bottom walls longitudinal edges 32 and 34.

In a preferred embodiment of the invention, the compartment top wall 22 and the compartment distal wall 26 are formed of an integrally extending piece of material. The integrally extending piece of material has a substantially J-shaped cross-sectional configuration. Each integrally extending top and bottom wall 22 and 26 integral piece of material is attached by a seal tight connection to an underlying similar integrally extending piece of material forming the top and bottom walls 22 and 26 of the collapsible compartment 20 located thereunder.

Thus, the compartment top wall 22 of the given collapsible compartment 20 forms part of the compartment bottom wall 34 of the overriding collapsible compartment 20. This method of manufacturing reduces the overall material needed to manufacture stacked collapsible compartments 20. In the embodiment illustrated in FIGS. 1 and 2, the integrally extending pieces of material are sealingly attached to adjacent integrally extending pieces of material by stitch lines generally identified by the reference numeral 36.

The collapsible compartments 20 are preferably stacked on top of each other with their respective proximal edges substantially in register to one another while their distal wall section 26 tapers proximally in a direction leading from the lowermost collapsible compartment 20 to the uppermost collapsible compartment 20 so as to define a restricting component distal angle 38 for reasons which will be hereinafter disclosed.

A set of restricting components 40 is preferably attached to both the top and bottom compartment walls 22 and 24 of each collapsible compartment 20. Each restricting component 40 preferably includes a main panel 42 made out of a substantially rigid material having a fold line 44 formed thereon. Each panel 42 is attached to the top and bottom compartment walls 22 and 24 by integrally extending connecting flaps 46. The connecting flaps 46 are preferably sewn at stitch lines 48 to the adjacent structure.

A screening means preferably taking the form of a flexible mesh preferably extends between the proximal edges 28 and 30 of corresponding adjacent compartment walls 22 and 24. For reasons of clarity, the mesh screen is not shown in FIGS. 1 to 7.

The buoyant component 12 preferably includes an elongated chamber or bladder 50 attached to the top compartment wall 22 of the uppermost collapsible compartment 20 adjacent the top wall proximal edge 28 thereof. The bladder 50 defines an enclosed chamber therein and is provided with pneumatic and/or hydraulic valve means for allowing selective flow of fluid therethrough. The valve means (not shown) may take any suitable form.

Both the buoyant and flow restricting components 12 and 14 are made of a suitable substantially flexible impervious material. Preferably, the substantially flexible and impervious material is a polymeric or elastomeric resin that can be transformed using conventional forms of manufacturing. Typically, the substantially flexible and impervious material is vinyl, reinforced neoprene rubber, butyl rubber or any other suitable material. The material must be flexible so as to allow the flood barrier 10 to transform itself between its collapsed configuration illustrated in FIG. 4 and its extended configuration illustrated in FIG. 3 using the liquid flowing into the collapsible compartments 20. Conversely, the flood barrier 10 must be able to collapse from its extended configuration illustrated in FIG. 3 to its collapsed configuration illustrated in FIG. 4 when the liquid flows out of the proximal edges of the collapsible compartment 20 as will be hereinafter disclosed. Also, fluid must be able to inflate the bladder 50 and the latter must be able to collapse when fluid is removed therefrom. It should be understood that other materials could be used without departing from the scope of the present invention. It should also be understood that other methods of joining such materials such as heat welding or the like may be used instead of the above-mentioned stitch lines without departing from the scope of the present invention.

The flood barrier preferably further includes a sealing skirt 52 mounted underneath the compartment bottom wall 24 of the lowermost collapsible compartment 20 adjacent the bottom wall proximal edge 30 thereof. The skirt 52 has a loose section thereof formed of a substantially flexible material adapted to conform to the contour of a ground surface used for supporting the flood barrier 10. The sealing skirt 52 is specifically provided for forming a water-tight seal so as to prevent liquids from flowing underneath the flood barrier 10.

The flood barrier 10 preferably further includes anchoring means for releasably anchoring the flood barrier 10 to the ground surface 54. The anchoring means preferably include an anchoring mat 56. The anchoring mat 56 has a set of spikes 58 extending from its lower surface. A mat connecting means 60 is mounted on the upper surface of the anchoring mat 56. In a preferred embodiment of the invention, the mat connecting means 60 takes the form of strips of miniature hook and loop-type fibers commonly referred to by the trademark VELCRO™ with corresponding miniature hook and loop-type fiber strips on the lower surface of the bottom wall 24 of the lowermost collapsible compartment 20.

The anchoring means may further include anchoring pegs 62 adapted to be inserted through corresponding peg apertures 64 provided in the flood barrier 10 and into the ground surface 54.

Figure 4:
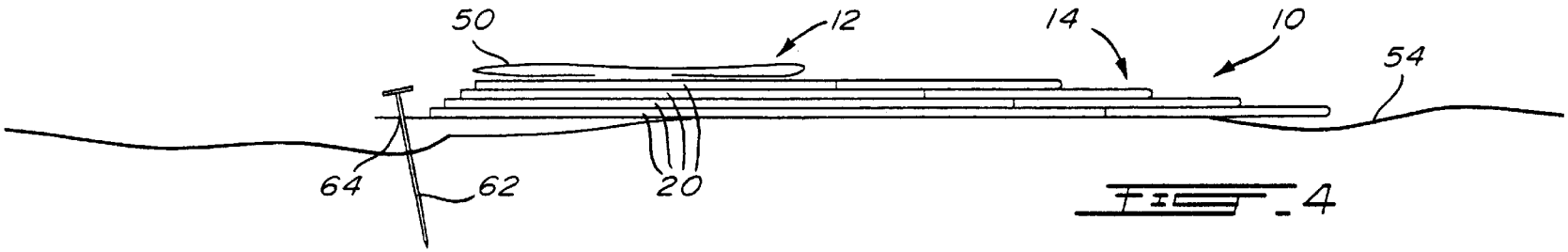
FIG. 4 is a side view illustrating the flood barrier of FIG. 3 in a collapsed configuration.

In use, the flood barrier 10 is positioned between incoming flooding liquid 66 and an area needing to be protected from the incoming flooding liquid 66. The flood barrier 10 may be easily carried to a suitable location since, once in the collapsed configuration illustrated in FIG. 4, it may be easily rolled up to facilitate manipulation and transportation. Once transported to a suitable location prior to contact with the incoming flooding liquid, the flood barrier 10 is deposited on the ground surface 54 in a collapsed configuration such as illustrated in FIG. 4. When needed, such as when the flood barrier 10 is installed on relatively slippery terrain such as ice, mud or the like, the anchoring means 62 may be used for anchoring the flood barrier 10 to the ground surface 54. When the anchoring mat 56 is to be used, it is initially anchored to the ground surface 54 prior to mounting the flow restricting component 14 thereon. The anchoring mat 56 is installed by inserting the spikes 58 in the ground surface 54 at a suitable location. The miniature hook and loop-type fiber strips 60 of the anchoring mat 56 are then put into register with the corresponding miniature hook and loop-type fiber strips 60 attached to the lowermost collapsible compartment 20. If further anchoring support is needed, the anchoring pegs 62 may be used by inserting the latter through corresponding apertures 64 provided in the flood barrier 10 and then driving the pegs 62 into the ground surface 54.

Figure 5:
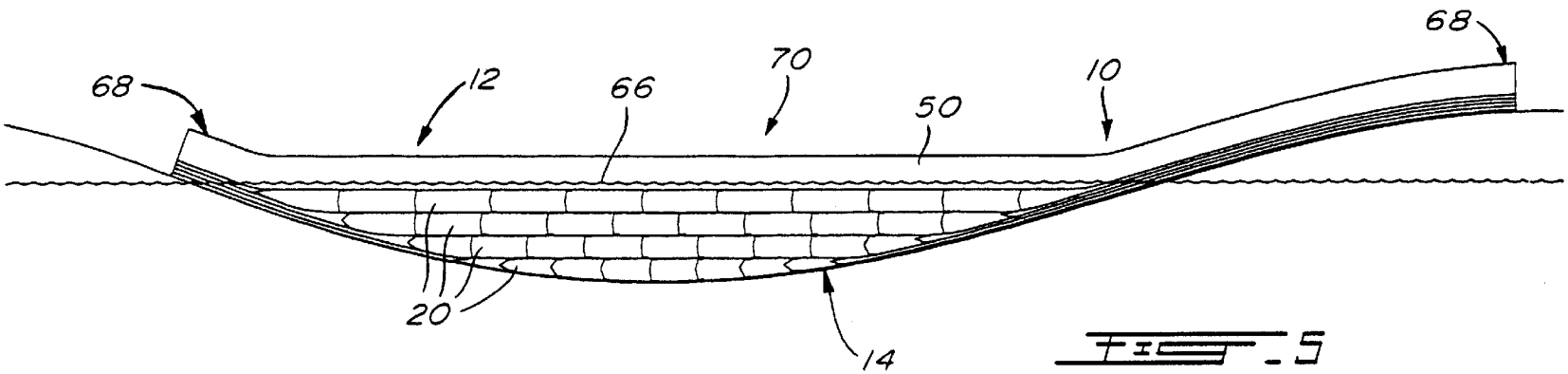
FIG. 5 is an elevational view illustrating the flood barrier of FIGS. 1 through 4 being used to prevent the flow of flood water through a depression formed in the ground surface.

As illustrated in FIG. 5, the flood barrier 10 is preferably positioned so that its longitudinal ends 68 are positioned above an intermediate section 70 thereof In order for the flood barrier to work adequately, the longitudinal ends 68 of the flood barrier 10 must be positioned so as not to come into contact with the incoming flood water for reasons which will hereinafter become obvious.

Once the flood barrier 10 is properly positioned at a suitable location, the bladder 50 may be inflated using any suitable inflation means such as an air compressor or ventilator. It should be understood that other fluids may be used without departing from the scope of the present invention as long as the fluids being used to inflate the bladder 50 allows the latter to float on top of the incoming flooding liquid 66.

Figure 3:
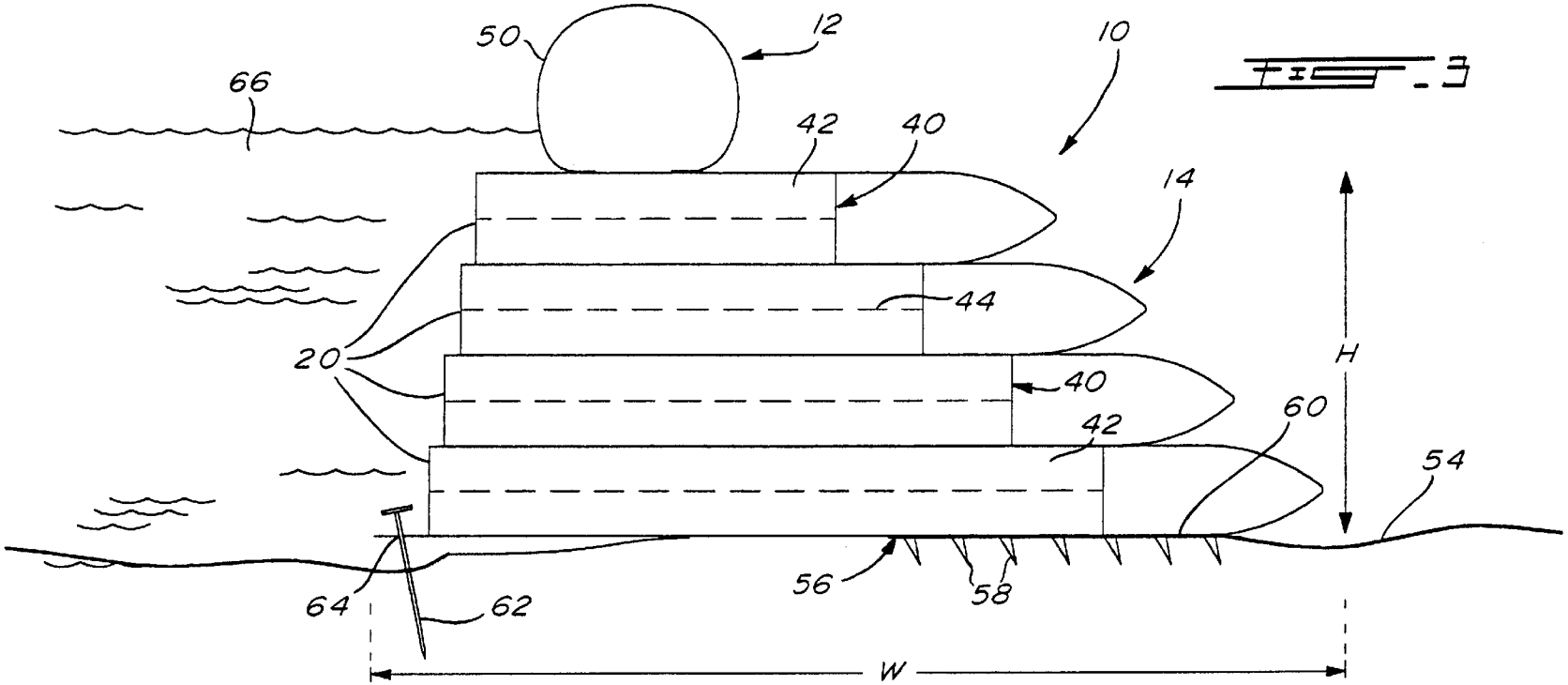
FIG. 3 is a side view illustrating the flood barrier of FIGS. 1 and 2 anchored to a ground surface and being used for restraining the flow of a body of water.

Once the bladder 50 is properly inflated, the incoming flooding water 66 will itself raise the flooding barrier 10 from its collapsed configuration illustrated in FIG. 4 to its raised configuration illustrated in FIG. 3. Indeed, as the incoming flooding water 60 reaches the bladder 50, the latter will have a tendency to float and thus displace upwardly, thus stretching the collapsible compartments 20 to their configuration illustrated in FIGS. 1, 2 and 3 while simultaneously unfolding the restricting components 40 previously folded about their fold lines 44. The incoming flow of flooding water 66 will eventually at least partially fill some of the collapsible compartments 20. While they are being filled, any air contained therein is vented through their respective longitudinal ends. Once the collapsible compartments 20 are filled with liquid, their respective front walls 26 prevent further flow of the incoming flooding water towards the terrain being protected by the flood barrier 10, as illustrated in FIG. 3. It should be appreciated that the restricting components 40 prevent adjacent collapsible compartments 20 from rolling on each other as they are being filled by incoming flooding water. Thus, preferably, the lowermost collapsible compartments 20 are provided with a greater number of restricting components 40 since they are subjected to greater hydraulic forces.

As the collapsible compartments 20 are filled with incoming flooding liquid, the hydraulic pressure formed by the column of water contained within the stack of collapsible compartments 20 exerts a downward pressure on the sealing skirt 52, thus ensuring that the latter provides a liquid-tight seal with the ground surface 54. Positioning of the bladder 50 adjacent the proximal edges 28 and 30 of the top and bottom walls 24 and 26 of the uppermost collapsible compartments 20 ensures a proper pulling action of the bladder 50 on the adjacent collapsible compartment 20 and thus ensures proper filling of the latter by incoming flooding water or liquid 66. As liquid flows into the collapsible compartments 20, the mesh screen (not shown) prevents debris such as branches, rocks and the like from penetrating within the collapsible compartments. The mesh screen thus prevents potential damage to the membrane forming the collapsible compartments 20 and facilitates emptying of the latter.

As mentioned previously, the flow restricting component distal angle 38 is steeper distally in a direction from top to bottom. Tapering of the flow restricting component distal angle 38 ensures that any liquid flowing over the flood barrier 10 will not merely drop over the top of the barrier 10 but rather flow smoothly along the distal configuration of the barrier 10 thus reducing the risk of hydraulically digging the surface adjacent the distal section of the barrier 10. By preventing such hydraulic digging action, the risk of destabilizing the flood barrier 10 is reduced.

Preferably, the width or transversal length of the lowermost collapsible compartment 20 has a value substantially in the range of one and a half times the height of the flood barrier 10 in its expanded configuration as shown in FIG. 3.

Figure 6:
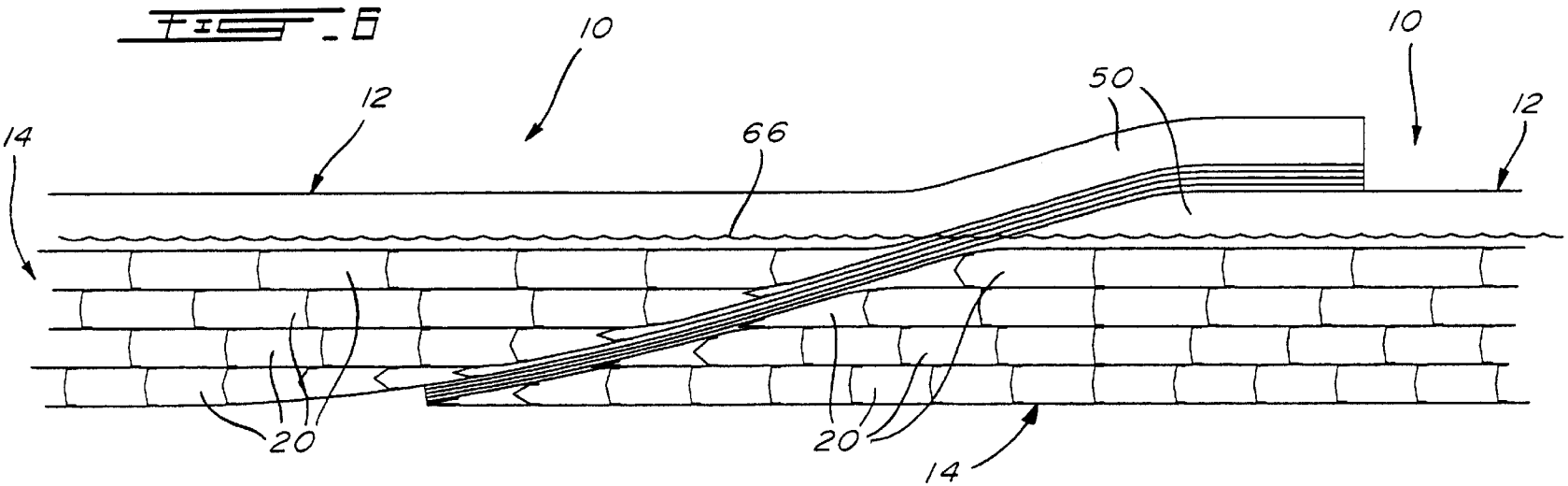
FIG. 6 is a partial elevational view with sections taken out, illustrating a link formed by a pair of adjacent flood barriers such as the flood barrier shown in FIGS. 1 through 5.
Figure 7:
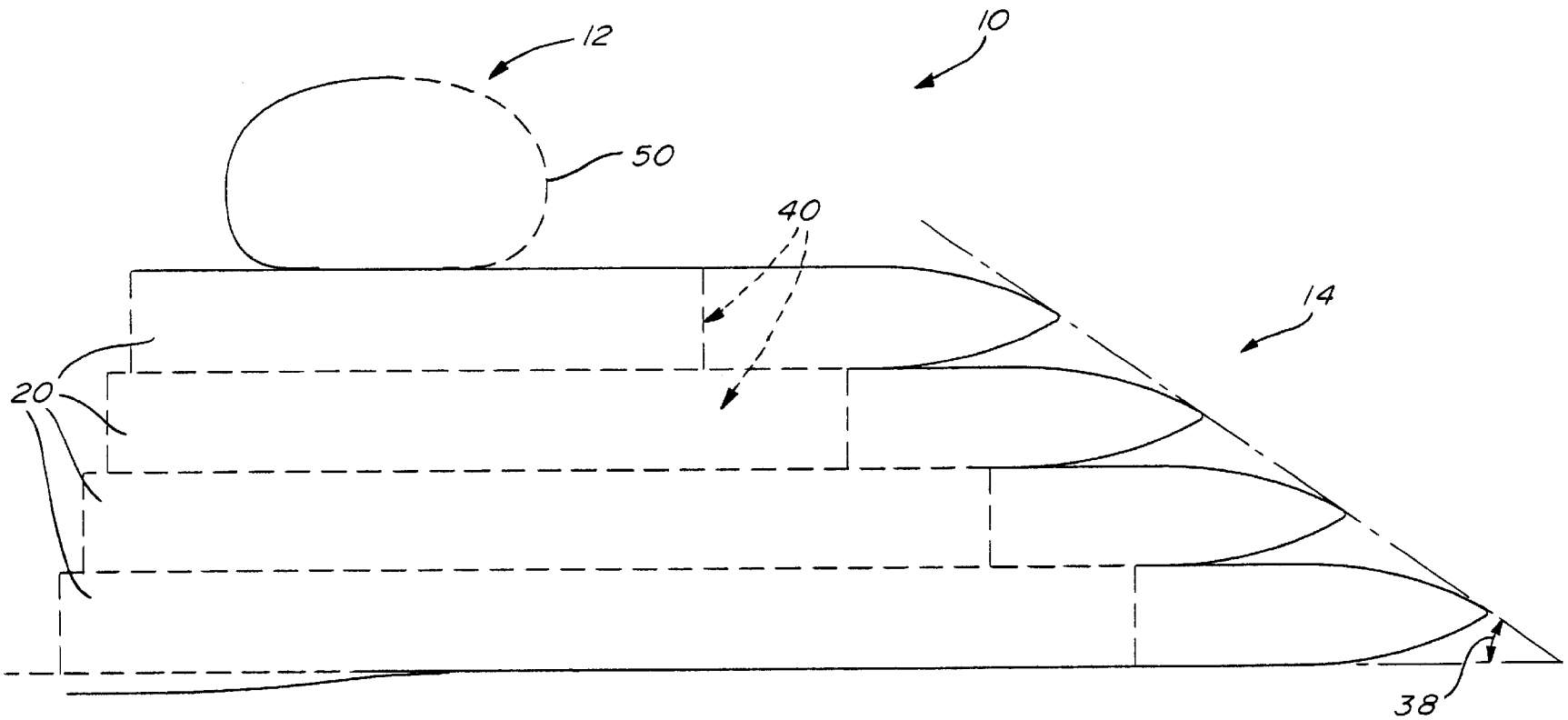
FIG. 7 is a schematic side view illustrating in full lines sections of a flood barrier such as the flood barrier illustrated in FIGS. 1 through 5 that must be joined with corresponding adjacent sections of another flood barrier with a sealed type connection when flood barriers are joined to one another, phantom lines being used to show non-connected sections of the flood barrier.

In situations wherein more than one flood barrier 10 may be needed to cover a relatively long distance, flood barriers 10 may be jointed in an end-to-end sealed relationship as illustrated in FIG. 6. In such situations, the adjacent end sections remain collapsed and a water-tight sealing means is used for sealing the end sections of the adjacent flood barriers 10 together. FIG. 7 illustrates in full lines sections of the flood barrier 10 that must be provided with water-tight sealing connections so as to ensure proper working of flood barrier combinations.

Although the flood barriers illustrated in FIGS. 1 to 7 have a generally linear elongated configuration, it should be understood that they could also be formed with other configurations such as generally angled configurations so as to provide efficient barriers in various settings such as when angles must be formed to adequately protect flood-prone areas. For example, a series of flood barriers 10 may be interconnected to form a continuous barrier enclosing a predetermined area to prevent flooding thereof.

Figures 10, 11, 12:
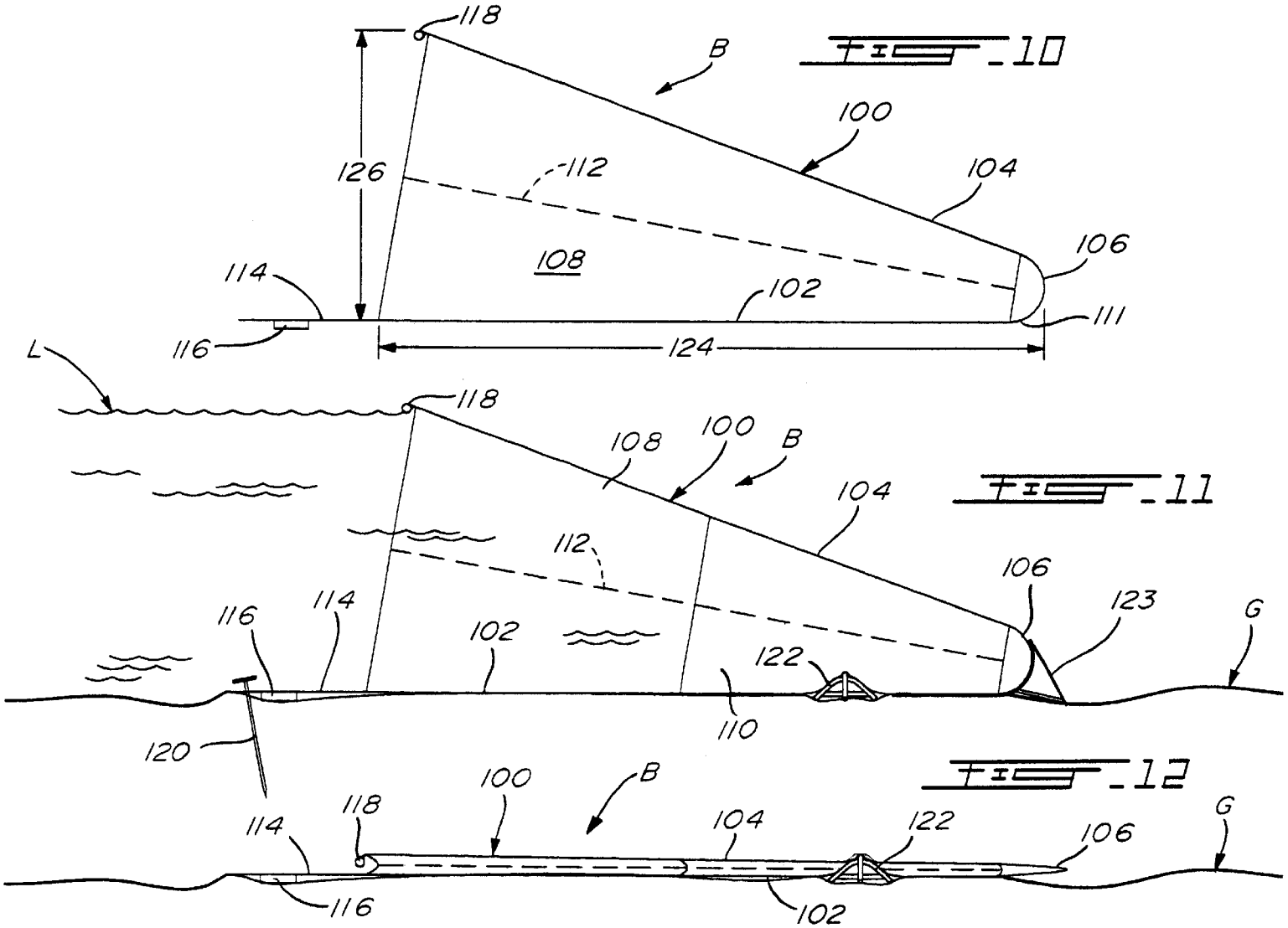
FIG. 10 is a schematic side elevational view of the flood control barrier of FIG. 8, shown in an expanded position.
FIG. 11 is a side elevational view similar to FIG. 10 but showing the flood control barrier in operation, i.e. restraining the flow of a body of water.
FIG. 12 is a schematic side elevational view showing the flood control barrier of FIG. 8 in a collapsed position thereof.

In accordance with a second embodiment of the present invention, FIGS. 8 to 13 show a flood control barrier B displaceable between its collapsed position of FIG. 12 and its deployed or expanded position of FIGS. 8 to 11 and 13. The present flood control barrier B constitutes a system for preventing floodings, wherein generally when the water of the flooding reaches the barrier B, the barrier B displaces from its collapsed position gradually to its expanded position such as to form an elongated barrier separating a flooded area from an area to be protected from flooding.

More particularly, the flood control barrier B comprises a substantially V-shaped unitary exterior membrane 100, made of a flexible material and including a lower section 102 and an upper section 104 joined at an apex 106 of the exterior membrane 100. The barrier B also comprises a series of first and second flexible partition walls 108 and 110 (for instance made of fabric) extending substantially vertically between the lower membrane section 102 and the upper membrane section 104 when the barrier B is in its expanded position. The first partition walls 108 extend forwardly from the apex 106 further than the second partition walls 110. The first and second partition walls 108 and 110 are alternately distributed in parallel and spaced apart relationship along the longitudinal direction of the exterior membrane 100.

Depending on the height of the barrier B and of the water pressure to be sustained thereby, the number, the sizes and the separation between the partition walls 108, 110 may be varied. Some barriers may not include any such partition walls (e.g. see barrier B' of FIGS. 16 and 17), and others may have partition walls of two distinct sizes, such as barrier B, although there could be three, four, five, etc., such distinct sizes. Typically the shorter partition walls reinforce the barrier where pressure is greatest.

The exterior membrane 100 may be made of two pieces joined, for instance, at location 111 in FIG. 10, whereby the apex 106 is part of the upper section 104. Using a seam to effect this connection, the upper and lower sections 104 and 102 could define outwardly of the seam a pair of bands extending exteriorly and rearwardly of the location 111 such as to generally overlie the ground G in a bib-like way. These bands are useful in preventing erosion of the ground under the rear end of the lower section 102 in the event that water flows above the barrier B, along the upper section 104, including the apex 106, and finally up to location 111.

The height of the exterior membrane 100 in its deployed position will depend on the amount of water to be contained by the barrier B. The exterior membrane 100 will have a sufficient length such as to appropriately contain the interrupted water flow. For instance, in the event that the flood control barrier B is laid across a stream or a river, as in FIG. 13, the barrier B will extend across the stream or river and will have its ends lying on the ground located on each side of the stream or river.

The exterior membrane 100 is made of a material which is supple, flexible, liquid impervious and restraint to tearing.

Figure 8:
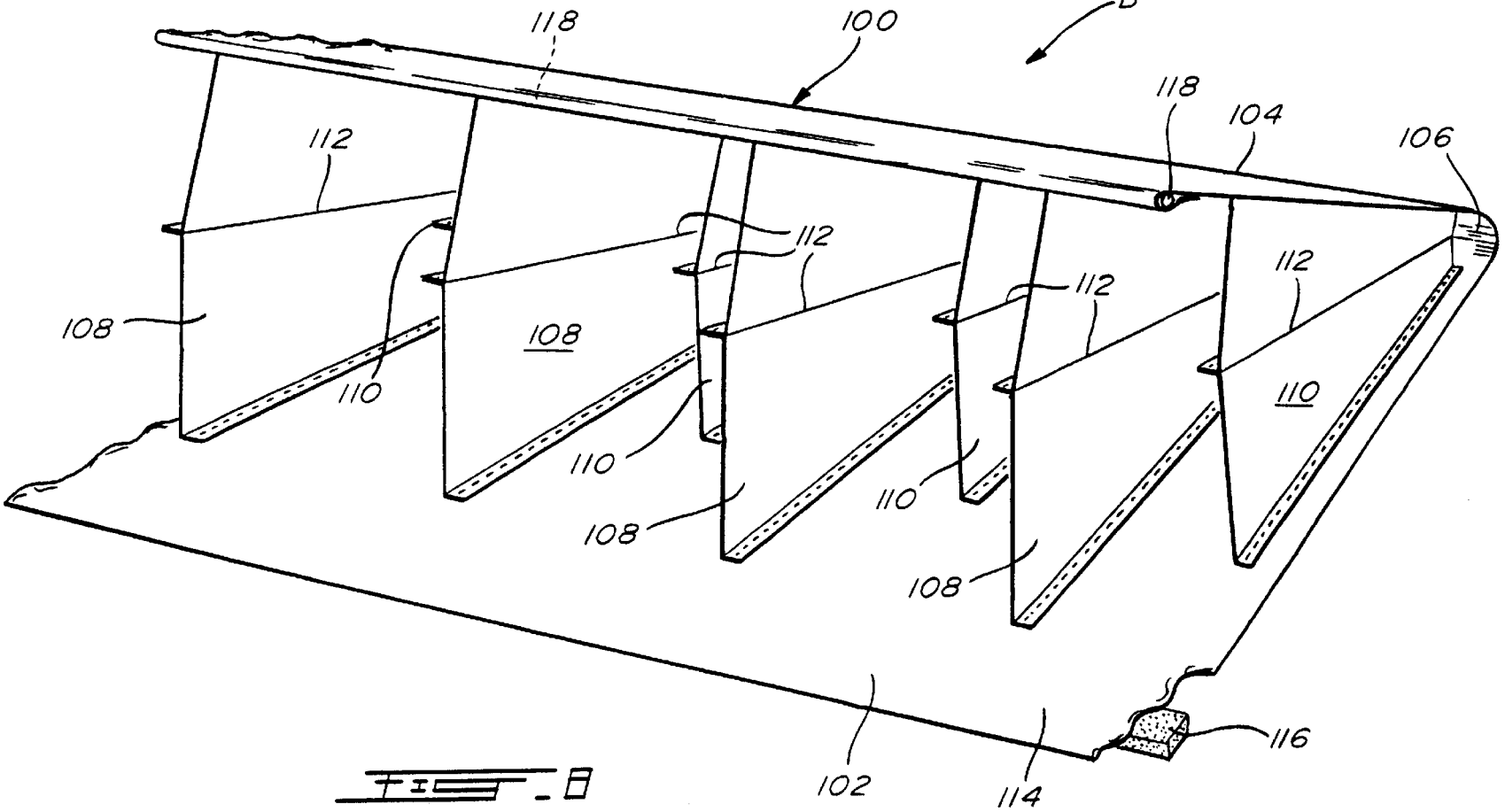
FIG. 8 is a partial front perspective view of a flood control barrier in an expanded position thereof in accordance with a second embodiment of the present invention.
Figure 9:
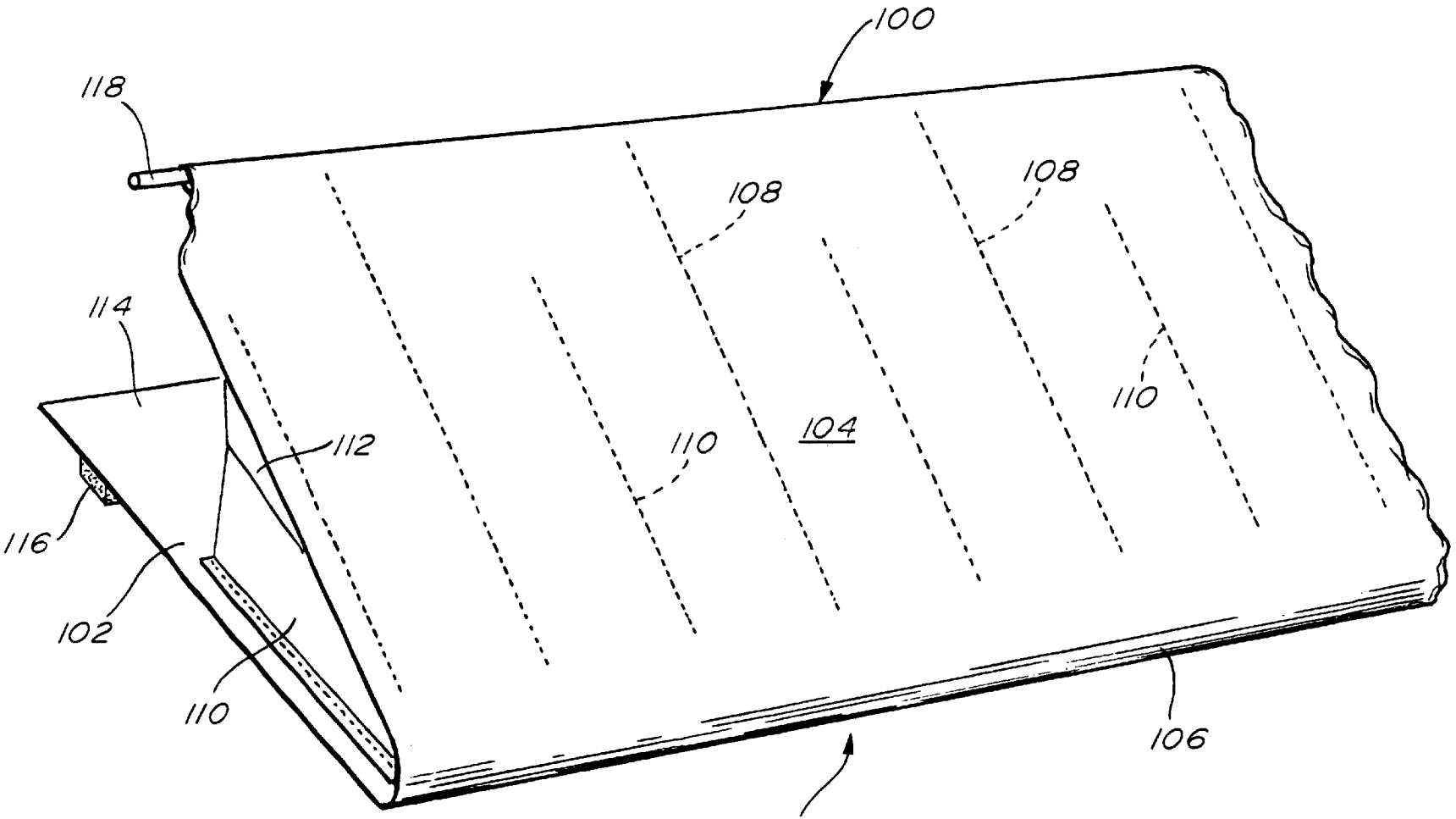
FIG. 9 is partial rear perspective view of the flood control barrier of FIG. 8.

The first and second partition walls 108 and 110 are used or provided for retaining the upper membrane section 104 in its uppermost position shown in FIG. 8. Without the partition walls 108 and 110, the water pressure could exert a thrust which could cause the upper membrane section 104 to be forced onto the ground, behind the lower membrane section 102 and substantially coplanarly therewith. The number of partition walls 108 and 110 depends on the size of the barrier B. The partition walls 108 and 110 will typically be made of a material which is supple, resistant to tearing and unextendable.

The partition walls 108 and 110 may be provided with fold creases 112 to facilitate the return of the barrier B to its collapsed position of FIG. 12. The folds 112 may structurally result from each partition wall 108 or 110 including two wall sections which are each first assembled, e.g. by sewing, to a respective one of the upper and lower membrane sections 104 and 102, and which are then assembled together at fold 112. This facilitates the initial construction of the barrier B.

A front end of the lower membrane section 102 defines an elongated flange or a bib 114 which extends basically forwardly from the front ends of the first partition walls 108. The bib 114, which could also be made from another material than that of the exterior membrane 100 and which would then be attached to a front end of the lower membrane 102, is used to prevent water from the flooding from passing under the flood control barrier B due to the water pressure exerted thereon. Indeed, the water pressure will act on the bib 114 as well as on the lower membrane section 102 and thus against the ground G underlying the lower membrane 102 and the bib 114 so as to retain the flood control barrier B in position on the ground G.

A further membrane or an elongated sponge member 116 may be secured to the underside of the bib 114 in order to provide a tighter seal between the bib 114 and the ground G in view of the imperfections that may be defined by the ground G supporting the flooding control barrier B. With the water pressure, this sponge member 116 will become more or less at least partly embedded in the ground G or the soil such as to in fact substantially merge therewith.

The flood control barrier B also comprises an elongated float 118 (made, for instance, of a lightweight material, such as polyethylene) which is located at a forward end of the upper membrane section 104, for instance as a bead within an elongated opening defined by a folded back portion of the upper membrane section 104, sewn or otherwise secured to the main portion of the upper membrane section 104. The float 118 may also take the form of an inflatable balloon. The float 118 is thus positioned on the side of the flooding area and is used to intercept the initial water flow for then assisting in the upward deployment of the upper membrane section 104 and the partition walls 108 and 110 such that the cavities defined in the flood control barrier B, vertically between the upper and lower membrane sections 102 and 104 and horizontally between the partition walls 108 and 110, may become filled with water. The float 118 is basically located forwardly adjacent to the front ends of the first partition walls 108.

Figure 20:
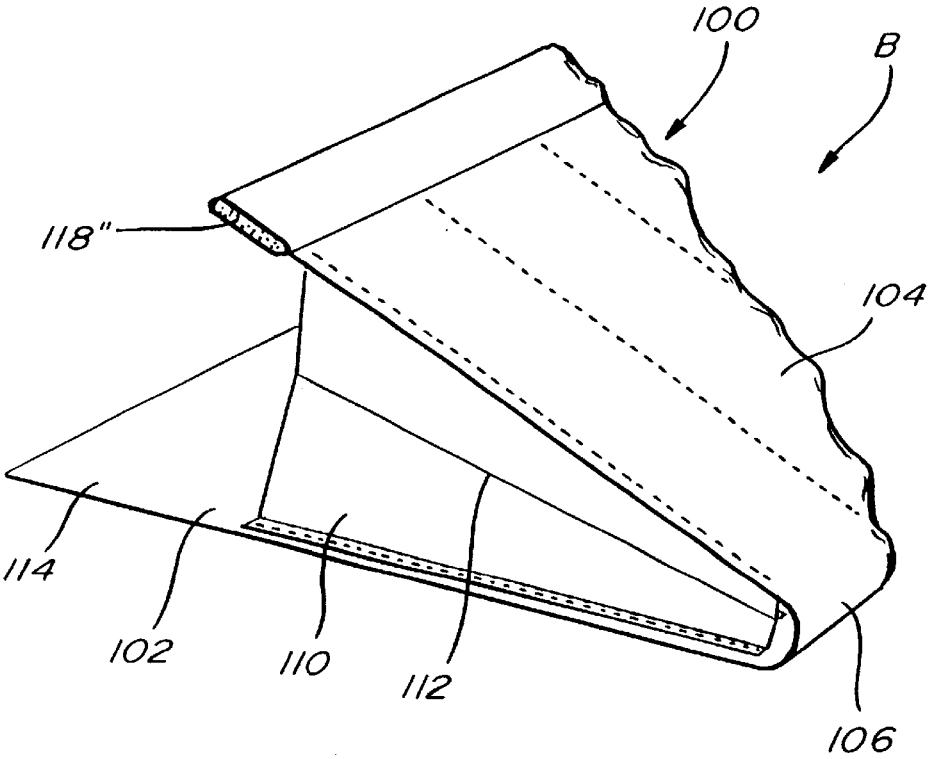
FIG. 20 is a partial rear perspective view of a flood control barrier similar to that of FIGS. 8 to 12 but provided with a variant float.

The float 118 may take a flattened configuration, such as the form of an ovum, as seen at 118" in FIG. 20. Such a configuration improves a reaction time of the float, thus facilitating the deployment of the flood barrier B when it receives a flow of water. This flattened shape of the float 118" also allows to better roll up the flood barrier B for storage thereof.

A flexible mesh (not herein shown) extending between the upper and lower membrane sections 104 and 102 and in front of the first partition walls 108 may be provided in certain applications. Such a mesh would extend substantially the length of the exterior membrane 100 and would act to prevent pieces of ice, branches, rocks and other debris from accessing the cavities defined between the upper and lower membrane sections 104 and 102 such as to prevent such debris from becoming attached to the flood control barrier B and possibly cause the water current of the flooding to sweep the barrier B. Such a mesh may also prevent the debris from damaging the flood control barrier B.

One or more anchors, such as stakes or pegs 120 (see FIG. 11) may be engaged through the lower membrane section 102, for instance through the bib 114 thereof, for further retaining the flood control barrier B in position on the soil. Such pegs 120 may be distributed in a spaced apart relationship along the bib 114 and would most likely be used in the event that the barrier B has to be positioned on a slippery surface (e.g. ice, mud, sand, etc.). The pegs 120 would be located at a front end, i.e. at an upstream end, of the lower membrane section 102.

Also with reference to FIG. 11, spikes 122 may be positioned underneath the lower membrane section 102, near a downstream end thereof. The spikes 122 which may be made of a metallic material are used to further retain the flood control barrier B in position on the ground G or soil by providing an abutment, in the form of a hump, under a rear portion of the barrier B. The spikes 122 may be used with or to replace the pegs 120.

Figure 18:
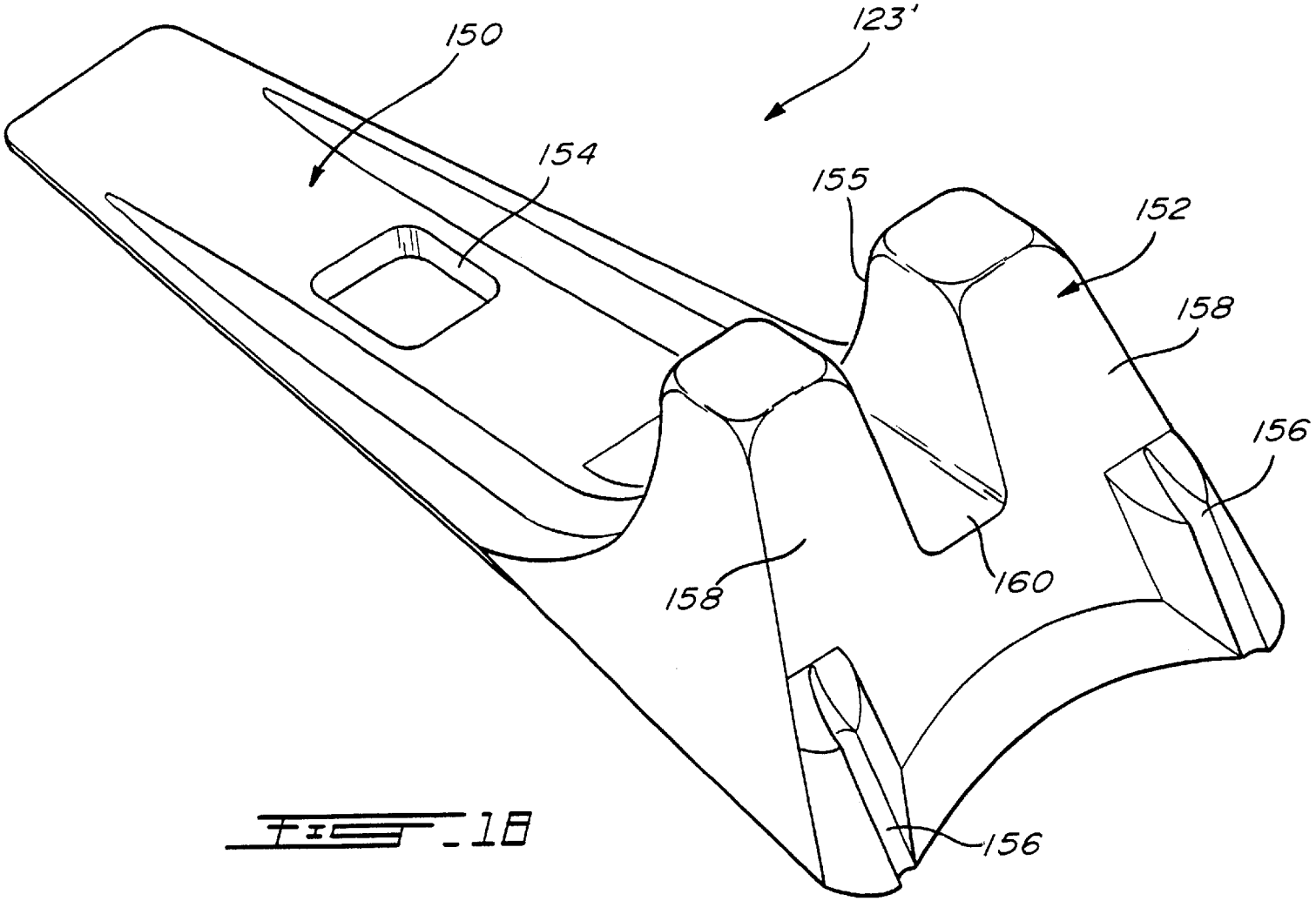
FIG. 18 is a detailed perspective view of the retention member of FIG. 11.
Figure 19:
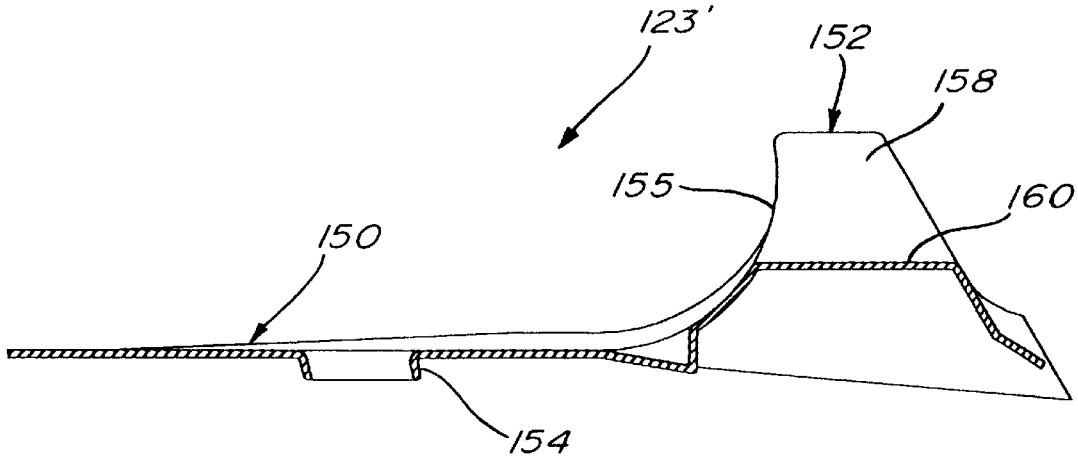
FIG. 19 is a longitudinal vertical cross sectional view of the retention member of FIG. 18.

In addition to, or in lieu of, the pegs 120 and the spikes 122, a further retention member 123 may be positioned behind the barrier B, in a somewhat partly wedged relationship between the apex 106 and the ground G, while outwardly following the contour of the apex 106. FIGS. 18 and 19 show a more elabotae retentin member 123' comprising a tongue member 150 adapted to be wedged under the rear end of the lower membrane section 102 and an abutment member 152 extending upwardly behind the apex 106 of the exterior membrane 100. The tongue member 150 defines a short tubular downwardly extending element 154 adapted to dig in the ground G. The abutment member 152 defines a concave front surface 155 that conforms with the exterior membrane 100. The abutment member 152 defines a pair of semi-cylindrical grooves 156 which serve as guides along which nails or spikes (not shown) may be driven in the ground G to better anchor the retention member 123'. The abutment member 152 is provided with a pair of spaced protrusions 158. As the retention members 123' are stackable in a nested relationship, a carrying belt (not shown) is used to hold the retention members 123' together for transportation purposes, the belt extending through the tubular element 154 and between the protrusions 158, i.e. against a flat surface 160.

Figure 13:
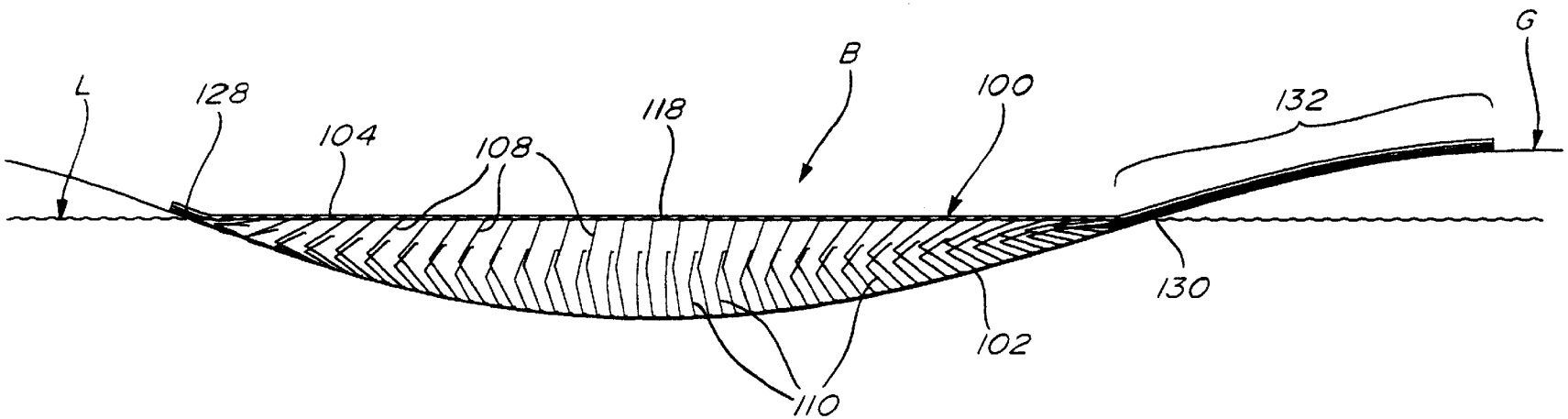
FIG. 13 is a front elevational view of the flood barrier of FIG. 8, shown in its expanded position and retaining a body of water as in FIG. 11, the flood control barrier of FIG. 13 extending, as an example, across a depression such as a stream or a river.

With reference to FIG. 10, a depth 124 of the barrier B should preferably be at least twice a height 126 thereof at float 118. The number of partition walls 108 and 110 varies depending on the level of the flooding to be retained by the barrier B. When considered longitudinally, the barrier B is typically exempt of closed ends, whereby the barrier B must be deployed such that the ends thereof are at least at the highest expected level of flooding. FIG. 13 shows an example of this configuration wherein reference numeral 128 denotes a beginning of the barrier B, reference numeral 130 denotes the end of the useful portion of the barrier B, and reference numeral 132 denotes an unused portion of the barrier B. Reference numeral G indicates the ground upon which the flood control barrier B is laid. In FIGS. 11 and 13, reference character L indicates the level of the flooding.

Figure 14:
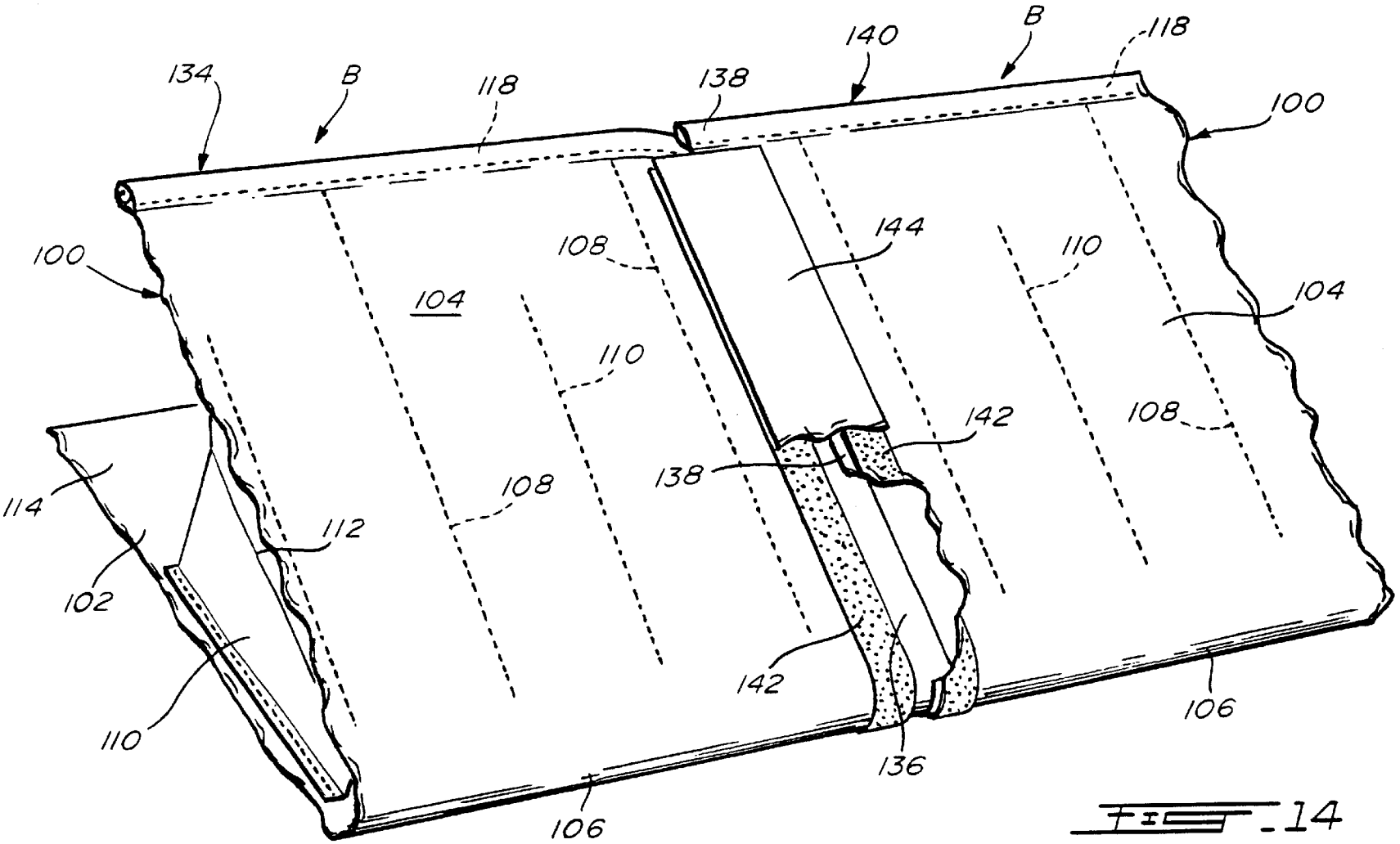
FIG. 14 is a partial front perspective view of a pair of flood control barriers of FIG. 8 which are shown in a connected end-to-end relationship.
Figure 15:
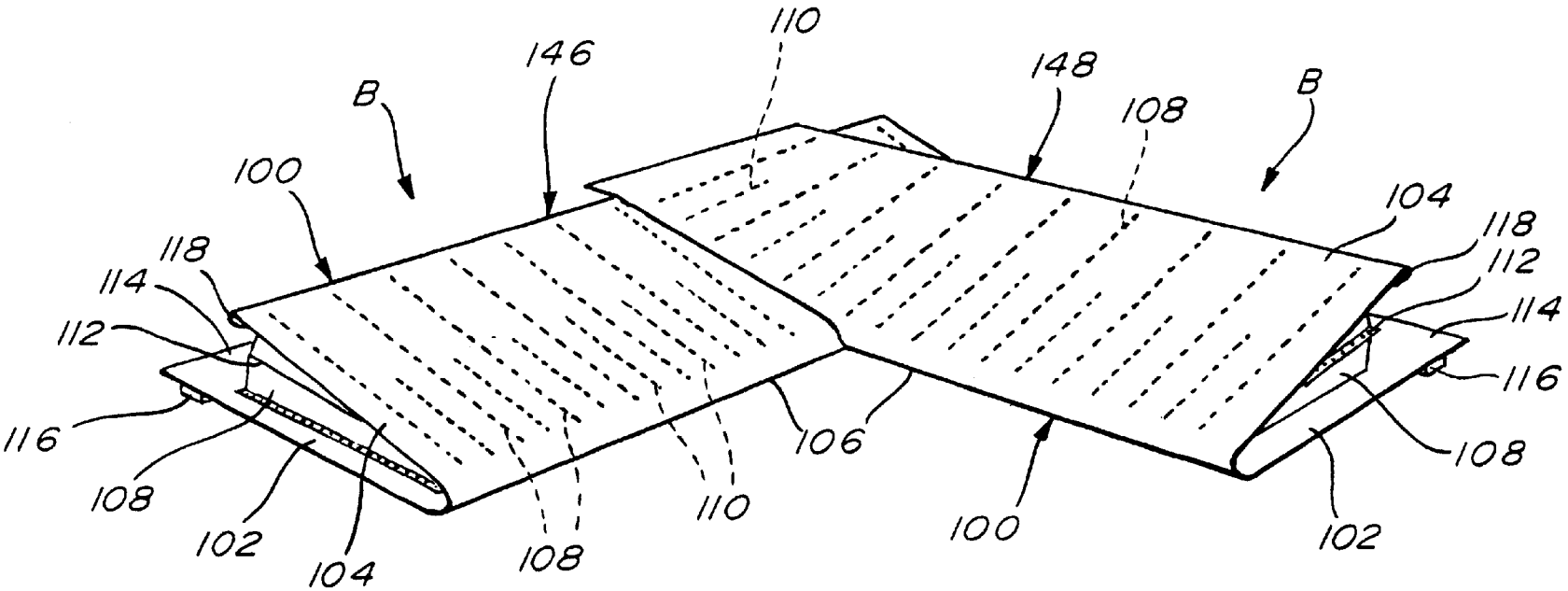
FIG. 15 is a schematic perspective view of a pair of flood control barriers of FIG. 8 which are shown connected in an angular relationship.

FIGS. 14 and 15 show the connection of two flood control barriers B respectively in an end-to-end aligned relationship and in an angled relationship. In FIG. 14, a lefthand barrier 134 has its end 136 inserted within an end 138 of a righthand barrier 140. Velcro™ is used to attach the two barriers 134 and 140 together as follows. The ends 136 and 138 of the barriers 134 and 140 are provided with female strips 142, i.e. the loop section of the Velcro™, with a single wider male strip 144 (i.e. the hook section of Velcro™) extending on and connecting both female strips 142 such as to securely attach the barriers 134 and 140 together. Other attachment mechanisms or systems may be used instead of Velcro™, such as Maxigrip™ plastic zipper-like closures where hooked ribs engage, in an uninterrupted way, in correspondingly configured grooves to secure two panels together with a tight seal. These closures can be used with plastic, woven and non-woven materials and be attached by heat seal, RF welding, stitching or bonding. They can be with two, three, or more, tracks/grooves.

FIG. 15 shows two barriers B connected together at the ends thereof but in an angular relationship as opposed to the aligned relationship of the barriers 134 and 140 of FIG. 14. A lefthand barrier 146 is shown with its end positioned under an end of a righthand barrier 148. As in FIG. 14, Velcro™-type attachments (or other suitable attachment systems) may be used to secure the lefthand and righthand barriers 146 and 148 together.

Figure 16:
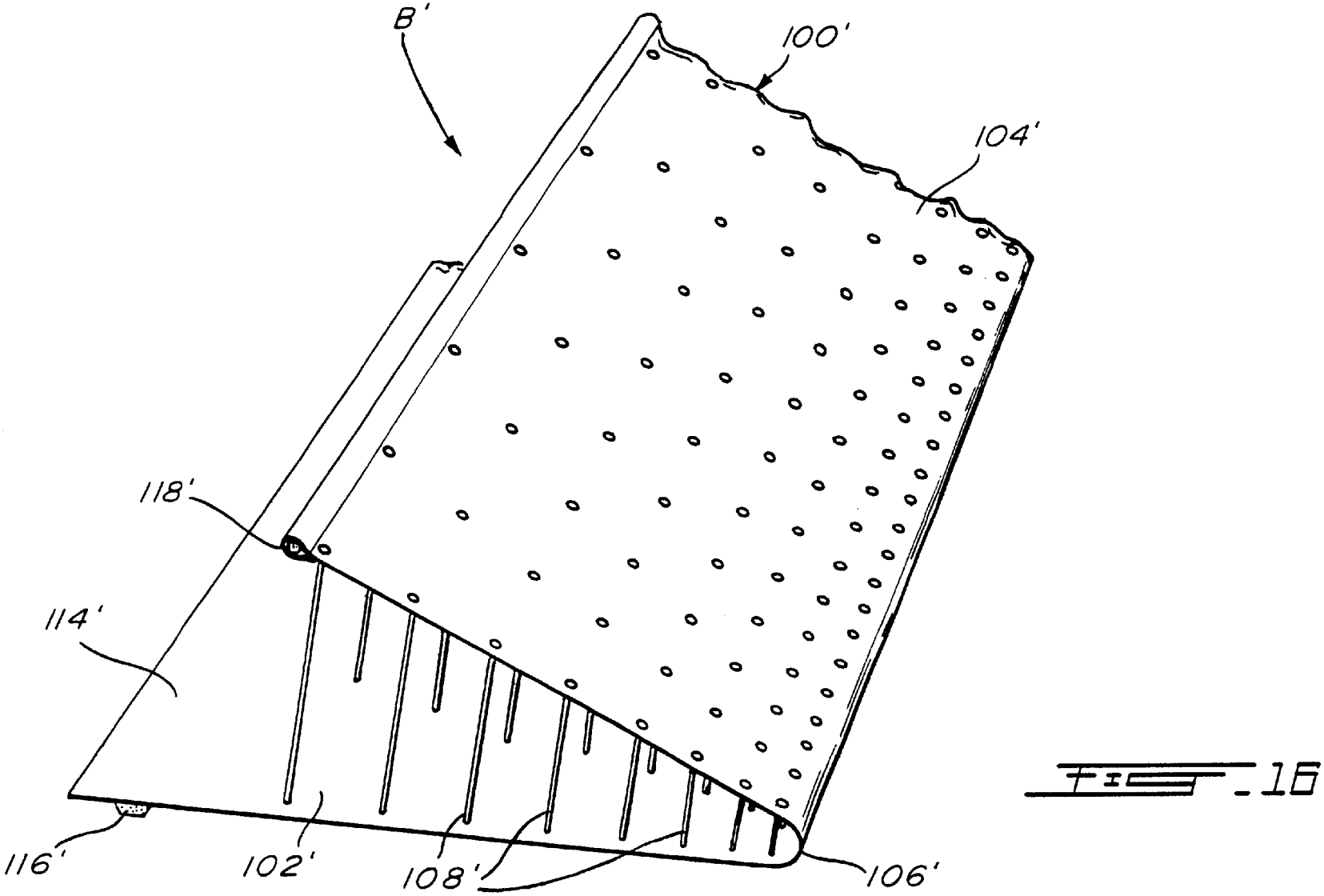
FIG. 16 is a partial front perspective view of a variant of the flood control barrier of FIGS. 8 to 13, in an expanded position thereof, also in accordance with the present invention.
Figure 17:
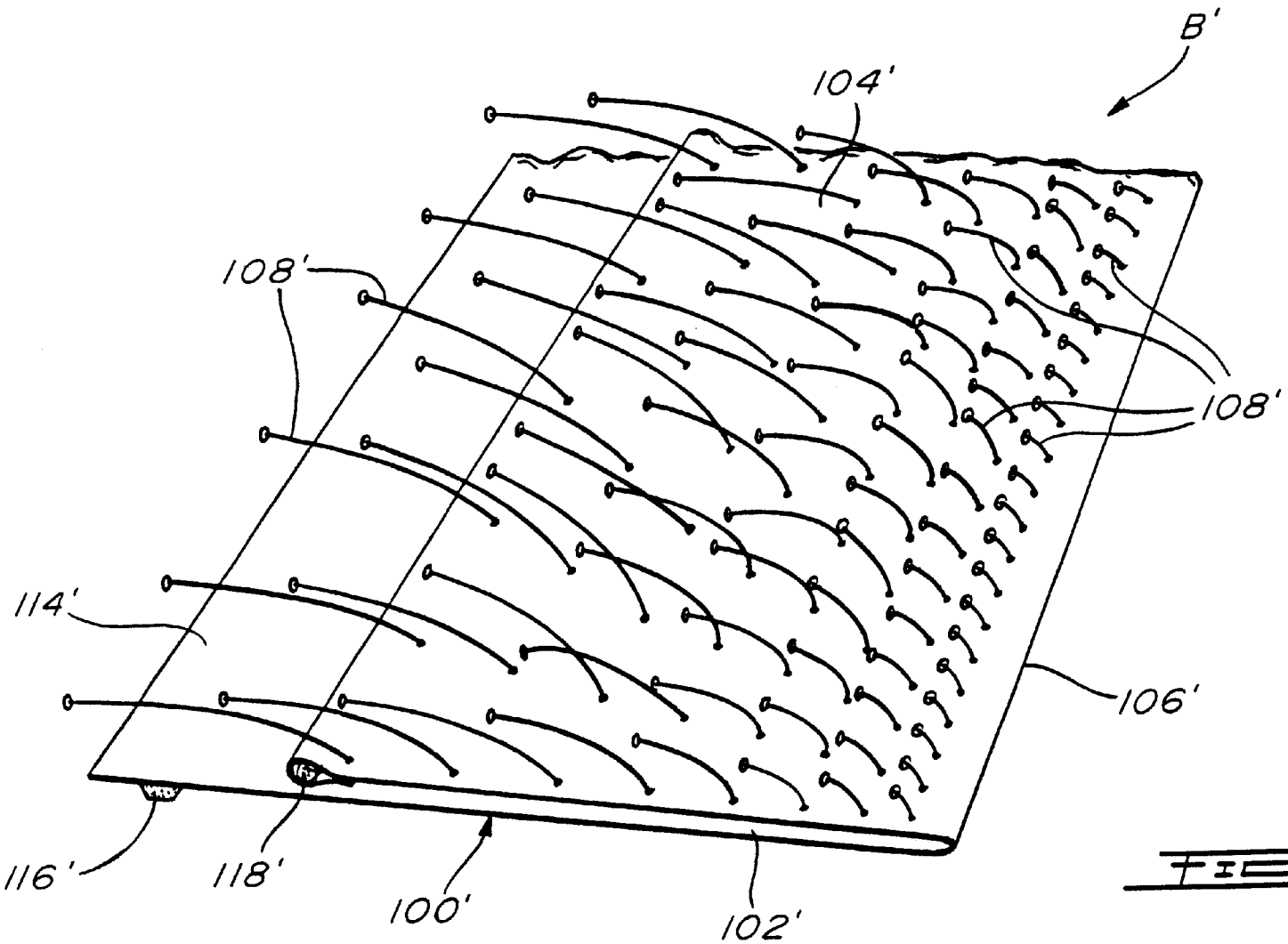
FIG. 17 is a partial front perspective view of the flood control barrier of FIG. 16 in a collapsed position thereof.

FIGS. 16 and 17 illustrate a flood control barrier B' which is a variant of the barrier B of FIGS. 8 to 13 and which differs therefrom in the way that upper and lower sections 102' and 104' of an exterior membrane 100' thereof are retained at a maximum limited distance from each other, when expanded. More particularly, the partition walls 108 and 110 of the barrier B have been replaced by ropes or cables 108' extending between the upper and lower sections 102' and 104'.

As seen in FIG. 17, the number of cables 108' is greater (e.g. per unit of length of the barrier B') at the rear of the barrier B', i.e. near the apex 106' thereof, than forwardly thereof as the water pressure increases from the bib 114' towards the apex 106'. The cables 108' may be, as illustrated, disposed in rows parallel to the longitudinal direction of the barrier B'. As the water flows out of the barrier B', the cables 108' may be pulled outwardly of the upper section 104' (see FIG. 17) such as to facilitate the rolling up of the barrier B' for storage purposes. This also prevents the cables 108' from becoming entangled during the collapsing and the storage of the barrier B'. Alternatively, the ends of the cables 108' may be affixed to the upper and lower sectons 102' and 104' of the barrier B' such that, when the barrier B' is collapsed, the cables 108' are loosely folded within the exterior membrane 100'.

Other systems which limit the opening up, during deployment of the barrier, of the upper section 104' with respect to the lower section 102' may obviously be contemplated as variants to the partition walls 108 and 110 of barrier B and the ropes or cables 108' of barrier B'. Typically, these systems are also capable of being collapsed.

Therefore, with the flood control barrier B of the present invention, it is readily understood that a more efficient barrier is provided than that resulting from the accumulation of thousands of bags of sand. Here, the bags of sand are replaced by "bags" of water, using the water from the flooding to inflate the present flood control barrier B such that the latter acts as a wall separating a flooded area from an area to be protected. By laying the barrier B before the water reaches it, the gradual increase in the level of the water will cause the barrier B to elevate therewith in a simple and efficient manner. Obviously, the laying of the present barrier b is much quicker than the accumulation of bags of sand or the like.

What is claimed is:

1. A barrier for retaining a liquid upstream thereof, comprising liquid impervious elongated upper and lower wall means joined at a closed longitudinal end of said barrier opposed to a substantially open longitudinal end thereof, said upper and lower wall means being displaceable between expanded and collapsed positions, said lower wall means being laid on a ground, wherein in said collapsed position, said upper wall means overly said lower wall means, whereas in said expanded position, said upper wall means is spaced from said lower wall means at said open end of said barrier such that a liquid may flow into said barrier through said open end while being restricted from flowing downstream past said barrier by said closed end thereof.

2. A barrier as defined in claim 1, wherein a plurality of partition wall means extend substantially vertically in said barrier between said upper and lower wall means and substantially perpendicularly to a longitudinal direction of said barrier.

3. A barrier as defined in claim 2, wherein said partition wall means are made of a flexible material.

4. A barrier as defined in claim 1, wherein retention means are provided for said lower wall means for assisting in preventing said barrier from displacing downstream along the ground.

5. A barrier as defined in claim 4, wherein said retention means comprise bib means extending upstream of said lower wall means and adapted to overly the ground.

6. A barrier as defined in claim 5, wherein said retention means further comprise stake means engaged through said bib means and into the ground.

7. A barrier as defined in claim 4, wherein said retention means comprise stake means engaged through said lower wall means and into the ground.

8. A barrier as defined in claim 4, wherein said retention means comprise spike means extending upwardly from the ground and underneath a rear end of said lower wall means.

9. A barrier as defined in claim 4, wherein said retention means comprise a retention member extending on the ground behind said closed end of said barrier.

10. A barrier as defined in claim 9, wherein said retention member comprises a tongue member adapted to extend under said closed end, and an abutment member adapted to bear against said closed end.

11. A barrier as defined in claim 10, wherein an anchor extends downwardly from said tongue member into the ground.

12. A barrier as defined in claim 10, wherein said abutment member defines a front concave surface for contacting said closed end.

13. A barrier as defined in claim 10, wherein said abutment member is provided with guide means for guiding elongated anchor means when driven into the ground.

14. A barrier as defined in claim 1, wherein a seal is provided on an underside of an upstream end of said lower wall means for preventing the liquid from flowing under said barrier.

15. A barrier as defined in claim 14, wherein said seal comprises an elongated sponge.

16. A barrier as defined in claim 1, wherein an upstream end of said upper wall means is provided with a float such that, as the liquid flows into said barrier, said upper wall means elevates with a level of the liquid while substantially maintaining said upstream end of said upper wall means above said level.

17. A barrier as defined in claim 16, wherein said float has a cross section shaped substantially as one of a circle and an ovum.

18. A barrier as defined in claim 1, wherein longitudinal ends of said barrier are open and adapted to be positioned at least at a highest expected level of the liquid to be retained by said barrier.

19. A barrier as defined in claim 1, wherein deployment limiting means are provided to limit a deployment of said barrier to said expanded position.

20. A barrier as defined in claim 19, wherein said limiting means comprise a plurality of partition wall means extending substantially vertically in said barrier between said upper and lower wall means and substantially perpendicularly to a longitudinal direction of said barrier.

21. A barrier as defined in claim 20, wherein each said partition wall means defines a fold line.

22. A barrier as defined in claim 19, wherein said limiting means comprise cable means extending in said barrier between said upper and lower wall means.

23. A barrier as defined in claim 1, in combination with a second similar barrier, both said barriers being interconnected together at adjacent ends thereof.

24. A barrier as defined in claim 23, wherein said barriers are interconnected in one of an end-to-end and an angled relationship.

25. A barrier as defined in claim 23, wherein attachment means are provided for securing said adjacent ends together.

26. A barrier as defined in claim 25, wherein said attachment means comprise cooperating mating elongated strips provided on said adjacent ends.

27. A barrier as defined in any one of claims 1 to 15, wherein said upper and lower wall means are comprised in a membrane means, there being provided at least a pair of said membrane means, said at least pair of membrane means being superposed and each having elongated upper and lower wall means joined at a closed longitudinal end of said membrane means opposed to an open longitudinal end thereof, each said membrane means being adapted to receive liquid through said open end with said upper wall means being spaced from said lower wall means at said open end of said membrane means in an expanded position of said membrane means such that liquid in said membrane means and upstream thereof is restricted from flowing downstream past said membrane means by said closed end thereof.

28. A barrier as defined in claim 27, wherein float means are provided on an uppermost one of said membrane means adjacent said open end.

29. A barrier as defined in claim 27, wherein deployment limiting means are provided to limit a deployment of said membrane means to said expanded position.

30. A barrier as defined in claim 29, wherein said limiting means comprise a plurality of partition wall means extending substantially vertically in said membrane means between said upper and lower wall means and substantially perpendicularly to a longitudinal direction of barrier.

31. A water barrier for separating a wet area from an area to be maintained substantially dry, comprising membrane means having elongated upper and lower wall means joined at a closed longitudinal end of said membrane means opposed to a substantially open longitudinal end thereof, said lower wall means having an upstream end adapted to overly a ground surface supporting said water barrier, said membrane means being adapted to receive water through said open end with said upper wall means being spaced from said lower wall means at said open end of said membrane means in an expanded position of said membrane means such that water in said membrane means and upstream thereof is restricted from flowing downstream past said membrane means by said closed end thereof.

* * * * *